US007980301B1

(12) United States Patent
Kostrov et al.

(10) Patent No.: US 7,980,301 B1
(45) Date of Patent: Jul. 19, 2011

(54) METHOD AND APPARATUS FOR THE DAMPENING OF SHOCKS IN THE BOREHOLE OF WELLS

(76) Inventors: Sergey Kostrov, Plano, TX (US); Bill Wooden, Plano, TX (US)

( * ) Notice: Subject to any disclaimer, the term of this patent is extended or adjusted under 35 U.S.C. 154(b) by 0 days.

(21) Appl. No.: 12/655,544

(22) Filed: Jan. 4, 2010

(51) Int. Cl.
*E21B 28/00* (2006.01)

(52) U.S. Cl. ..... 166/177.1; 166/177.6

(58) Field of Classification Search ..... 166/249, 166/177.1, 177.2, 177.5, 177.6
See application file for complete search history.

(56) References Cited

U.S. PATENT DOCUMENTS 3,209,834 A * 10/1965 Essary ..... 166/177.2
5,586,602 A * 12/1996 Vagin ..... 166/249
6,015,010 A * 1/2000 Kostrov ..... 166/249
6,899,175 B2 * 5/2005 Kostrov et al. ..... 166/249
2006/0249286 A1 * 11/2006 Serdjukov et al. ..... 166/249

* cited by examiner

*Primary Examiner* — Daniel P Stephenson

(57) ABSTRACT

The method and apparatus for dampening of sudden shocks in the wells filled by liquid wherein the tubing pump is used in which on upstroke of pumping unit the damper plunger and tubing pump plunger are moving in concordance thereby compressing the liquid contained within the damper chamber and allowing the liquid inside the damper chamber to be discharged into the internal volume of tubing string above damper plunger providing a dampening counterforce inside the damper chamber, i.e. when the damper plunger is displaced upwardly in the elongated damper cylinder, the damper plunger having a diameter smaller than diameter of the tubing pump plunger causes the compression of liquid inside the damper chamber thereby creating a dampening force.

9 Claims, 3 Drawing Sheets

METHOD AND APPARATUS FOR THE DAMPENING OF SHOCKS IN THE BOREHOLE OF WELLS

BACKGROUND OF THE INVENTION

The present invention relates to generating a dampening counterforce in a well borehole having the appearance of a sudden shock during the process of oil production and seismic stimulation.

BRIEF DESCRIPTION OF PRIOR ART

It is a well known phenomenon in oil production wells for sudden shocks to appear on the upstroke or down stroke of a pumping unit due to contamination of the borehole by fines, debris or sand entering between the plunger and cylinder of tubing pump, this causes a sudden increase in frictional forces and a corresponding increase in load on the pumping unit which is then followed by a sudden and dramatic drop in load at the top of the upstroke/down stroke of the pumping unit thereby causing a negative load on pumping unit due to inertia forces. Such changes between high positive and negative loads on a pumping unit can lead to rapid damage to the pumping unit transmission and bearings.

Various methods and devices for shock absorbing are known in the patented prior art. For instance U.S. Pat. No. 4,176,714, No. 4,354,395, No. 4,354,397, No. 6,109,355, 6,810,953, herein incorporated by reference, disclose methods and apparatuses wherein a mechanical cushion means or friction action is used to provide shock absorbing. However, the efficiency and reliability of such devices is limited due to the fact that necessary changes in absorbing characteristics that are depended on each particular well conditions are not made and the mechanical cushion means have short lifespan. U.S. Pat. No. 6,905,114, herein incorporated by reference, discloses a method and apparatus based on hydraulic cushion which is more efficient as compared with mechanical cushion means. However this shock absorbing apparatus has moving parts relative to the sucker rod string which would cause rapid wear of shock absorbing apparatus. As well this apparatus does not create a constant dampening counterforce and it takes some time for such apparatus to generate a counterforce, thus shock forces would be transferred to the pumping unit.

The U.S. Pat. No. 6,015,010 and No. 6,899,175, herein incorporated by reference, disclose methods and apparatuses for increasing the efficiency of shock wave stimulation of oil bearing beds. However the implementation of methods in accordance with U.S. Pat. No. 6,899,175 and No. 6,015,010 have their drawbacks, i.e. the apparatuses might cause possible damage of the pumping unit transmission and bearings due to the periodic high positive and negative loads on the pumping unit at the top of each upstroke of pumping unit as a consequence of the apparatus operation in accordance with methods described in U.S. Pat. No. 6,899,175 and No. 6,015,010. As in the case for standard tubing pump operation when the tubing pump is contaminated by fines, debris or sand, such periodic loads appear as a result of the sudden drop in load at the top of the upstroke when a stretched rod string, due to the compression in devices described in U.S. Pat. No. 6,899,175 and No. 6,015,010, starts to constrict with a velocity of the speed of sound and the resulting inertia force exceeds the weight of the rod string, thus creating a negative load on the pumping unit.

The present invention was developed to overcome drawbacks of prior methods and devices by providing a method and apparatus for generating a constant dampening counterforce exceeding a negative load on the pumping and thus eliminating the negative stress on bearings and transmission of the pumping unit thereby substantially improving reliability of oil production equipment and efficiency of oil production technique wherein the pumping unit is used as well as efficiency of seismic stimulation technique.

SUMMARY OF INVENTION

Accordingly, a primary object of the present invention is to provide a method and apparatus for providing a constant dampening counterforce for dampening of sudden shocks in wells filled by liquid wherein the tubing pump is used which includes a pumping unit arranged at the wellhead, a tubing string extending downwardly into well borehole, an elongated damper cylinder connected with the bottom of tubing string at the upper end and connected with a damper chamber at lower end which in turn is connected to a tubing pump cylinder which has a tubing pump plunger within said tubing pump cylinder to provide a production of liquid from the borehole of the well. The elongated damper cylinder has an internal diameter smaller than the internal diameter of tubing pump cylinder. In addition the damper plunger movably arranged within said elongated damper cylinder and connected at its upper end to pumping unit by means of at least one sucker rod and polish rod and connected at its lower end to tubing pump plunger by means of at least one sucker rod has an internal diameter smaller than diameter of said tubing pump plunger, and said damper plunger has at least one channel providing a hydraulic connection between the damper chamber and the internal volume of tubing string above the damper plunger. On upstroke of pumping unit a liquid, contained inside the damper chamber between damper plunger and tubing pump plunger, is compressed thereby causing a liquid in said damper chamber to flow through said at least one channel into the internal volume of tubing string above damper plunger thereby providing a constant pressure inside said damper chamber and, as a result, providing the constant dampening counterforce or additional constant dampening load for pumping unit at the moment when any kind of upward shocks occur and the load on pumping unit is reduced and can become negative. The dampening counterforce inside damper chamber is determined by a formulae:

$$F = \frac{\pi^3}{128} k \rho \frac{L^2}{t^2} \frac{(D^2 - d^2)^3}{S^2},$$

where F is dampening counterforce, k is experimental coefficient of hydrodynamic resistance varied between 3 to 7, ρ is density of liquid in borehole of the well, L is length of stroke, t is the time of upstroke, D is diameter of tubing pump plunger, d is diameter of the damper plunger, S is the square area of at least one channel in the damper plunger, π equals 3.1415.

It is another object of the invention to provide an apparatus for providing the dampening counterforce in which at least one channel connecting the damper chamber and the internal volume of tubing string above damper plunger has a square area determined by the formulae:

$$S = \frac{\pi}{8}\frac{L}{t}\sqrt{\frac{\pi}{2}k\rho\frac{(D^2-d^2)^3}{gG}},$$

where G is the required additional constant dampening load on pumping unit on the upstroke, k is experimental coefficient of the hydrodynamic resistance varied between 3 to 7, ρ is density of liquid in borehole of the well, L is length of stroke, t is a time of upstroke, D is diameter of tubing pump plunger, d is diameter of the damper plunger, S is the square area of at least one channel in the damper plunger, π equals 3.1415, g is a gravity acceleration, G=(0.1 to 10) $G_2$, wherein $G_2$ is weight of sucker rod string from surface to the damper plunger.

It is another object of the invention to provide an apparatus for providing the dampening counterforce in which at least one channel connecting the damper chamber with the internal volume of tubing string above damper plunger is made as a groove on outer surface of the damper plunger or/and on internal surface of the elongated damper cylinder.

It is another object of the invention to provide an apparatus for providing the dampening counterforce in which a volume of damper chamber is determined by the following expression:

$$\frac{\pi\beta fL(D^2-d^2)}{4P_{max}} \le V \le \frac{\pi^2\beta fL(D^2-d^2)^2}{16G},$$

where V is the volume of the damper chamber, G is the required additional constant dampening load on pumping unit on the upstroke, L is length of stroke, D is diameter of tubing pump plunger, d is diameter of the damper plunger, π equals 3.1415, β is a compressibility of fluid in damper chamber, f is experimental coefficient of fluid leakage between, correspondingly, elongated damper cylinder and damper plunger and tubing pump cylinder and tubing pump plunger (f=0.5 to 0.7), $P_{max}$ is a collapse resistance pressure of damper chamber ($P_{max}$=56 to 74 MPa). It should be noted that required additional dampening load G on pumping unit on the upstroke must fulfill the following inequality:

$$G \ge \frac{\pi k\rho Q^2(D^2-d^2)}{8gS^2},$$

where Q is fluid flow rate from the well provided by operation of tubing pump. If this inequality is not fulfilled then the bigger value of G and correspondingly smaller volume of the damper chamber V is chosen to match the inequality.

It is another object of the invention to provide an apparatus for providing the dampening counterforce in which there are a plurality of channels connecting the damper chamber and the internal volume of tubing string above damper plunger and each channel has a square area defined by the formulae:

$$S_i = k_i\frac{S}{n},$$

where $S_i$ is square area of one of channels connecting the damper chamber and the internal volume of tubing string above damper chamber, $k_1$ is coefficient of hydrodynamic resistance in each of channels ($k_1$=3 to 7), n is number of channels, S is total square area of plurality of channels and i=1, 2, 3 . . . n.

It is another object of the invention to provide an apparatus for providing the dampening counterforce in which the bottom of damper chamber is connected to the apparatus for generating shock waves comprising an upper and lower cylinders and cross-sectional area of upper cylinder is less than cross-sectional area of lower cylinder, compression chamber connected to the bottom of upper cylinder at its upper end and to the top of lower cylinder at its lower end, upper and lower plungers movably arranged to move within the upper and lower cylinders, correspondingly, and connected to each other by means of at least one rod and upper plunger is connected to the bottom of damper plunger by at least one rod for compressing a liquid contained within compression chamber and discharging the liquid into borehole when lower plunger exits out of lower cylinder on upstroke thereby generating a shock wave.

It is another object of the invention to provide an apparatus for providing the dampening counterforce in which the damper plunger does not have said at least one channel but the damper chamber has at least one hole providing hydraulic communication between damper chamber and borehole of the well and said hole has a square area determined by the formulae:

$$S = \frac{\pi}{8}\frac{L}{t}\sqrt{\frac{\pi}{2}k\rho\frac{(D^2-d^2)^3}{g(G_2-G_1)}},$$

where $G_1$ is the loss of load on pumping unit at the top of upstroke, $G_2$ is a weight of sucker rod string from surface to the damper plunger, g is an acceleration of gravity, k is experimental coefficient of hydrodynamic resistance varied between 3 to 7, ρ is density of liquid in borehole of the well, L is length of stroke, t is a time of upstroke, D is a diameter of upper plunger of apparatus the for generating shock waves, d is diameter of the damper plunger, S is the square area of at least one hole in the damper chamber, π equals 3.1415, g is gravity acceleration, $G_1$=(1 to 1.5)$G_2$.

It is another object of the invention to provide an apparatus for providing the dampening counterforce in which the damper plunger has the diameter bigger than the diameter of the upper plunger of apparatus for generating shock waves for vacuuming the liquid contained within the damper chamber and allowing the liquid from borehole of the well to be discharged into the damper chamber on upstroke of pumping unit thereby providing a dampening counterforce inside said damper chamber in accordance with a formulae:

$$F = \frac{\pi^3}{128}k\rho\frac{L^2}{t^2}\frac{(d^2-D^2)^3}{S^2},$$

where F is counterforce, k is experimental coefficient of hydrodynamic resistance varied between 3 to 7, ρ is density of liquid in borehole of the well, L is length of stroke, t is the time of upstroke, D is diameter of upper plunger of apparatus for generating shock waves, d is diameter of the damper plunger, S is the square area of at least one hole in the damper chamber, π equals 3.1415. The liquid being under vacuum starts to flow through the at least one hole made in the damper chamber from the well's borehole into the damper chamber providing constant pressure inside the damper chamber and as a result a constant dampening counterforce for pumping unit at the moment when a shock wave is generated and the load on pumping unit becomes less than the weight of the sucker rod string.

It is another object of present invention to provide an apparatus for providing the dampening counterforce in which at least one hole has an angle ϕ of axis of symmetry different from 90° relatively the longitudinal axis of symmetry of the damper chamber.

BRIEF DESCRIPTION OF THE DRAWINGS

Other objects and advantages of the invention will become apparent from the study of the following specification when viewed in light of the accompanying drawings, in which.

DETAILED DESCRIPTION

Figure 1:
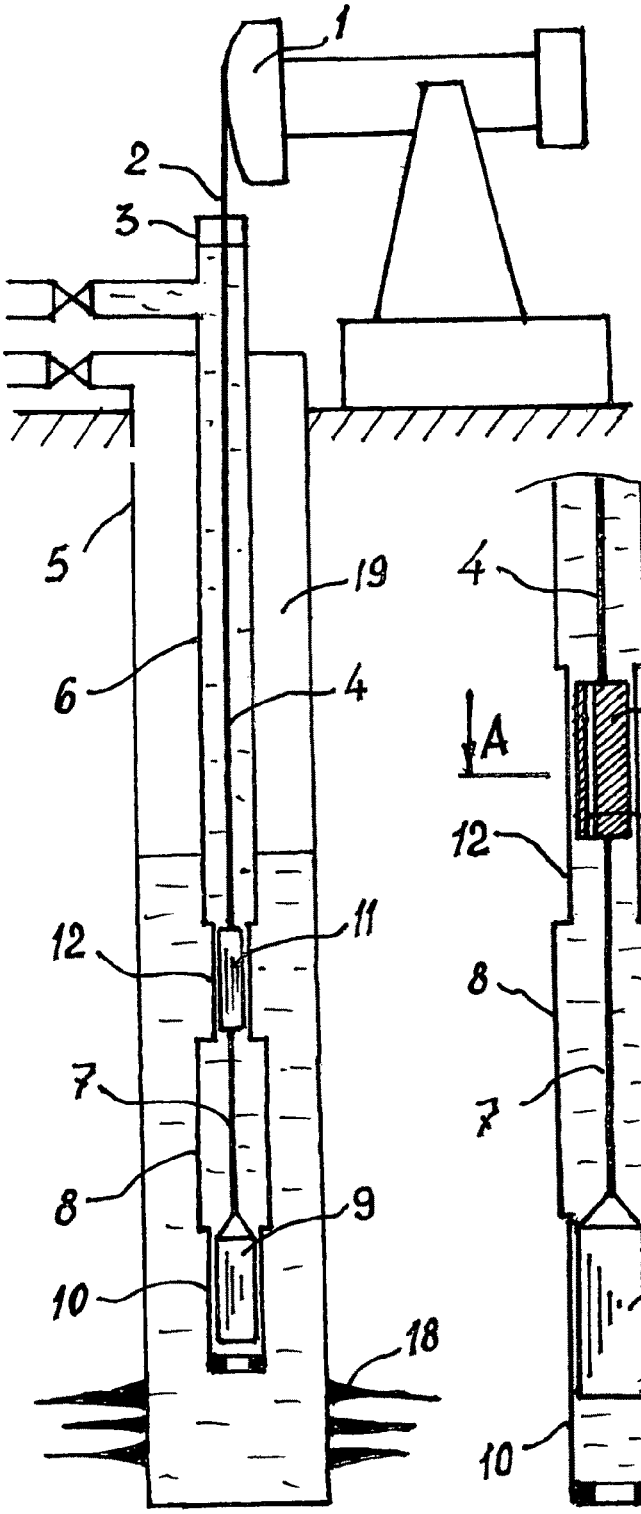
FIG. 1 is a cross-sectional side view of the device with tubing pump according to the invention installed in the well borehole.
Figure 2:
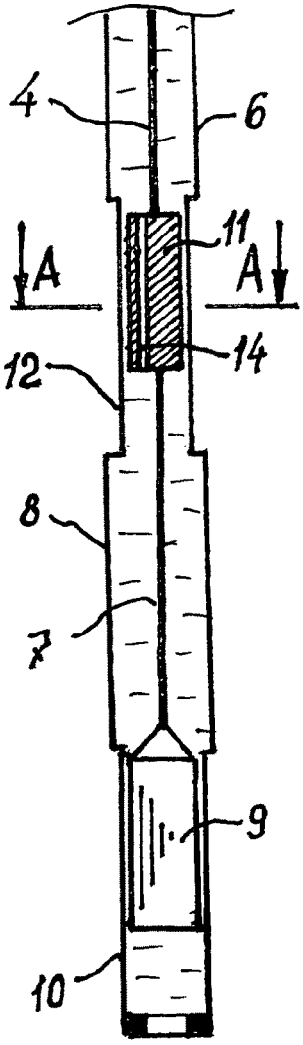
FIG. 2 is a cross-sectional view of the elongated damper cylinder, damper chamber, damper plunger and a tubing pump.
Figure 2A:
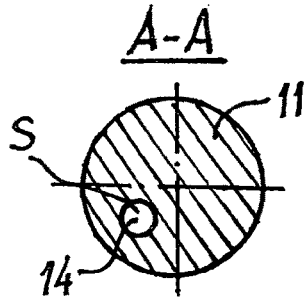
FIG. 2*a* is cross-sectional view of damper plunger having a channel.
Figure 2B:
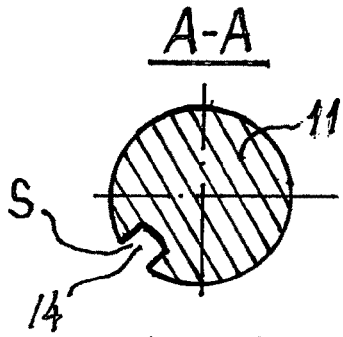
FIG. 2*b* is cross-sectional view of damper plunger having a groove.

Referring to FIG. 1 and FIG. 2, there is shown a device for providing the dampening counterforce in the borehole 19 of the well filled by liquid wherein a tubing pump consisting of tubing pump cylinder 10 and tubing pump plunger 9 is installed. The device includes a pumping unit 1 arranged at the wellhead of the well, a tubing string 6 extending downwardly into the production casing 5 of the well, the elongated damper cylinder 12 installed at the end of tubing string 6, the damper chamber 8 installed at the end of the elongated damper cylinder 12 and connected to the tubing pump cylinder 10, the damper plunger 11 moveably arranged within the elongated damper cylinder 12 and connected at its upper end to the pumping unit 1 by means of sucker rod string 4, having at least one sucker rod and a polish rod 2 via stuffing box 3, and connected at its lower end by means of at least one sucker rod 7 to the tubing pump plunger 9 which in turn is arranged within tubing pump cylinder 10 to provide a production of fluid from the oil bearing formation to the borehole 19 of the well via perforations 18. As shown on FIG. 2 and FIG. 2*a* the damper plunger 11 has at least one channel 14 providing a hydraulic connection between the damper chamber 8 and the internal volume of tubing string 6 above the damper plunger 11. As an alternative to the channel 14, as shown on FIG. 2*b*, the damper plunger 11 or/and elongated damper cylinder 12 has at least one groove 14 providing a hydraulic connection between the damper chamber 8 and the internal volume of tubing string 6 above the damper plunger 11.

Figure 3:
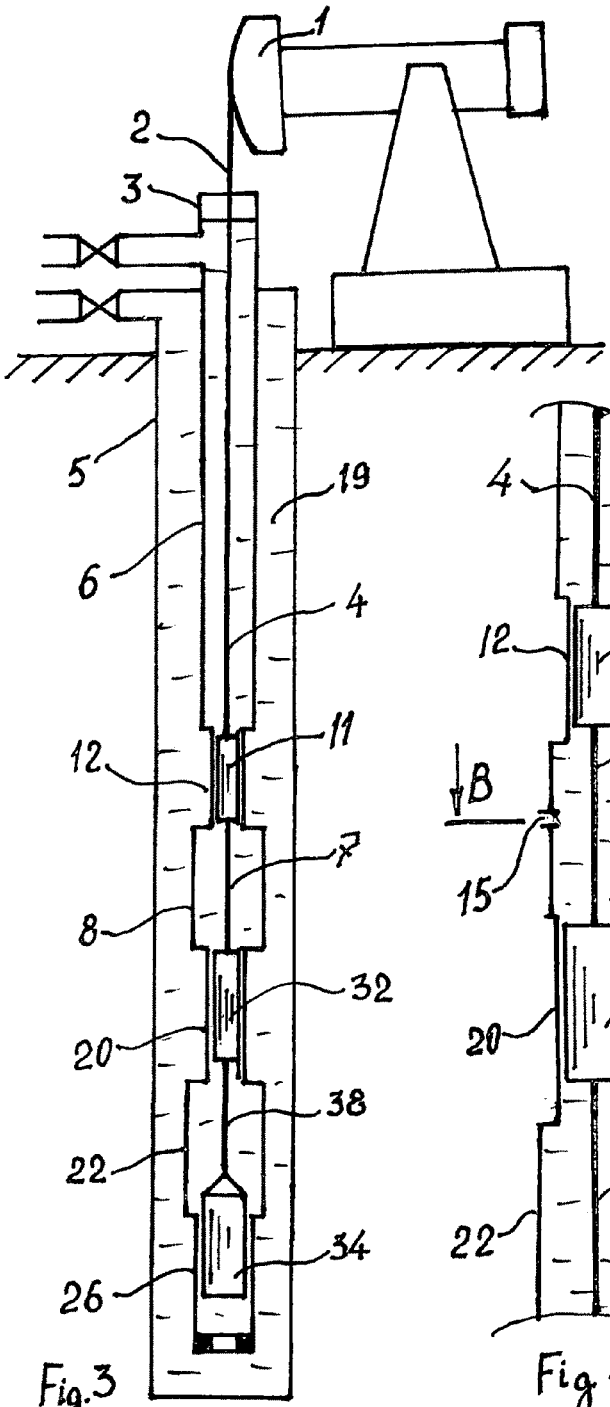
FIG. 3 is a cross-sectional side view of the device with apparatus for generating shock waves installed in the well borehole.
Figure 4:
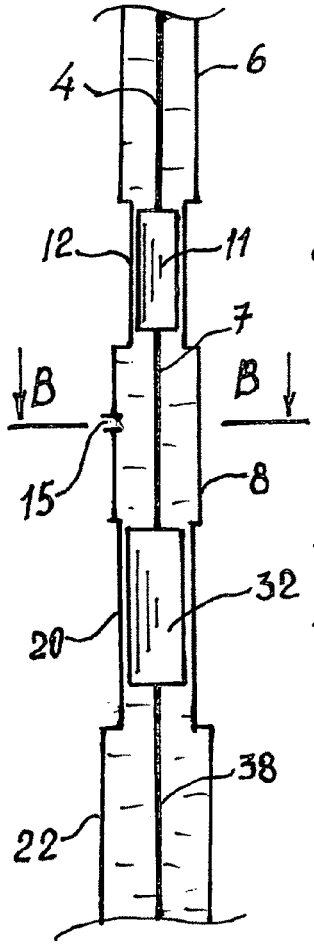
FIG. 4 is a cross-sectional view of the elongated damper cylinder, damper chamber, and apparatus for generating a shock waves.
Figure 4A:
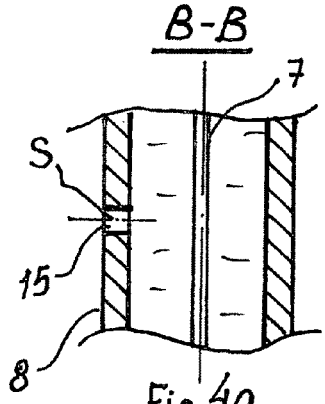
FIG. 4*a* is cross-sectional view of damper chamber with a hole.
Figure 4B:
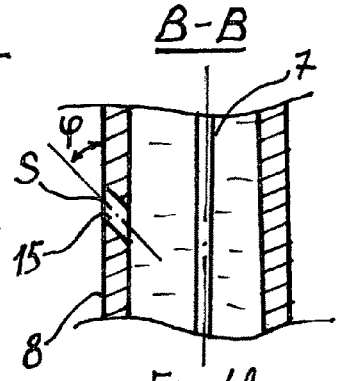
FIG. 4*b* is cross-sectional view of damper chamber with a hole having an angle ϕ of axis of symmetry different from 90° relatively the longitudinal axis of symmetry of the damper chamber.

Referring to FIG. 3 and FIG. 4, there is shown a device for producing the dampening counterforce in the borehole 19 of the well wherein the device for generating of a shock waves in the borehole 19 is installed. The device includes a pumping unit 1 arranged at the wellhead of the well, a tubing string 6 extending downwardly into the production casing 5 of the well, the elongated damper cylinder 12 installed at the end of tubing string 6, the damper chamber 8 installed at the end of the elongated damper cylinder 12 and connected to the upper cylinder 20 of apparatus for generating a shock waves which in turn is connected to the compression chamber 22 connected to lower cylinder 26 of apparatus for generating a shock waves. The damper plunger 11 is moveably arranged within the elongated damper cylinder 12 and connected at its upper end to the pumping unit 1 by means of sucker rod string 4, having at least one sucker rod and a polish rod 2, and connected at its lower end by means of at least one sucker rod 7 to the upper plunger 32 of and said upper plunger 32 is moveably arranged within upper cylinder 20 of apparatus for generating shock waves. The upper plunger 32 is connected at its lower end by means of at least one sucker rod 38 to the lower plunger 34 of device for generating shock waves which is moveably arranged within lower cylinder 26 of apparatus for generating shock waves. The damper plunger 11 has at least one channel 14 providing a hydraulic connection between the damper chamber 8 and the internal volume of tubing string 6 above the damper plunger 11. As an alternative to the channel 14, as shown on FIG. 4 and FIG. 4*a*, the damper chamber has at least one hole 15 providing hydraulic communication between internal volume of the damper chamber 8 and the well borehole 19 and said hole 15 could be made with an angle ϕ of axis of symmetry different from 90° relatively the longitudinal axis of symmetry of the damper chamber (FIG. 4*b*) in order to prevent erosion of casing 5 by jets from the hole 15 in case it is located in close vicinity of casing 5. The walls of the hole 15 can also be made of material like tungsten carbide to avoid erosion.

Operation:

The creation of constant dampening counterforce in case of using of tubing pump in accordance with present invention is as follows (FIGS. 1 and 2): during the upstroke of pumping unit 1, the damper plunger 11 and tubing pump plunger 9 are moving in concordance upward thereby compressing the liquid inside the damper chamber 8 due to the fact that the tubing pump plunger 9 has a bigger diameter compared with the diameter of damper plunger 11 causing the fluid to flow through at least one channel 14 at constant velocity thereby keeping the pressure inside the damper chamber 8 constant too. If there is some kind of obstacles between tubing pump plunger 9 and cylinder 10 then it would cause the appearance of shock force which might exceed the weight of rod string 4 after overcoming such force by pumping unit 1 and this force could cause the negative load on pumping unit 1 resulting in damaging of transmission and bearings of pumping unit. But due to the constant pressure created inside the damper chamber 8 and, as a consequence a constant dampening counterforce, the load on the pumping unit 1 does not reach zero or becomes negative. On the down stroke the liquid from the tubing pump refills the volume inside the damper chamber 8 and on the next upstroke the process repeats itself. There is the best application of the present invention for each combination of the following parameters: well depth, diameters of plungers 9 and 11, length of stroke, weight of rod string 4, number of stroke per minute, properties of fluid, square area of at least one channel 14. The optimum square area of at least one channel 14 is determined by the formulae:

$$S = \frac{\pi}{8}\frac{L}{t}\sqrt{\frac{\pi}{2}k\rho\frac{(D^2-d^2)^3}{gG}},$$

where G is the required additional constant dampening load on pumping unit 1 on the upstroke, k is experimental coefficient of the hydrodynamic resistance varied between 3 to 7, ρ is density of liquid in borehole 19 of the well, L is length of stroke, t is a time of upstroke, D is diameter of tubing pump plunger 9, d is diameter of the damper plunger 11, S is the square area of at least one channel 14 in the damper plunger 11, π equals 3.1415, g is gravity acceleration, G=(0.1 to 10) $G_2$, wherein $G_2$ is weight of sucker rod string 4 from surface to the damper plunger 11.

In particular, for the 3.66 meter length of stroke of pumping unit 1, six stroke per minute or 5 seconds of upstroke time, weight of the rod string 4 accounting for 1800 kg, the required additional constant dampening load G on pumping unit 1 on the upstroke accounting 1000 kg, diameter of plunger 9 accounting for 0.06985 m, diameter of damper plunger 11 equaled 0.05715 m, density of liquid equaled 1000 kg/m$^3$, g=9.81 m/sec$^2$ and coefficient of hydrodynamic pressure drop equaled 4 the optimum square area of at least one hole 18 accounts for $1.49\times10^{-5}$ m$^2$.

It should be noted that required additional constant dampening load G on pumping unit on the upstroke must fulfill the following inequality:

$$G \geq \frac{\pi k\rho Q^2(D^2-d^2)}{8gS^2},$$

For above noted parameters and flow rate of fluid equaled 100 BOPD or $1.9\times10^{-4}$ m$^3$/sec provided by tubing pump the required additional constant dampening load G must be higher than 20 kg or 45 lbs. So above noted inequality is fulfilled (required additional constant dampening load G=1000 kg).

The corresponding dampening counterforce F is determined by formulae:

$$F = \frac{\pi^3}{128}k\rho\frac{L^2}{t^2}\frac{(D^2-d^2)^3}{S^2}.$$

For above noted parameters the dampening counterforce F equals 9800 N or 2200 lbs.

In case of use of an apparatus for generating shock waves the operation is similar to the one with tubing pump above and is as follows (FIGS. 3 and 4).

During the upstroke of pumping unit 1, the plungers 11 and 32 moving upward in concordance compress the liquid inside the damper chamber 8 due to the fact that the upper plunger 32 has a bigger diameter compared with the diameter of damper plunger 11 causing the liquid to flow through at least one hole 15 at constant velocity thereby keeping the pressure inside the damper chamber 8 constant too. When shock wave is generated in the apparatus for generating shock waves the stretched rod string 4 is constricted causing the appearance of upward force which might exceed the weight of rod string 4. But due to the constant pressure created inside the damper chamber 8, and as consequence, the downward dampening counterforce, the load on the pumping unit 1 does not reach zero or becomes negative. On the down stroke the liquid from the well's borehole 19 refills the internal volume the damper chamber 8 via the at least one hole 15 (FIG. 4*a*) and on the next upstroke the process repeats itself. The hole 15 can be made under some angle (not equal 90°) to the axis of longitudinal symmetry of the damper chamber 8 (FIG. 4*b*) in order to prevent the damage of casing 5 due to the jets of fluid flowing via hole 15 in case the outside diameter of the damper chamber 15 is in close vicinity of casing 5.

There is the best application of the present invention in case of using an apparatus for generating shock waves for each combination of the following parameters: well depth, diameters of plungers 11 and 32, length of stroke, weight of rod string 4, number of stroke per minute, density of liquid, square area of at least one hole 15. The optimum square area of at least one hole 15 is determined by the formulae:

$$S = \frac{\pi}{8}\frac{L}{t}\sqrt{\frac{\pi}{2}k\rho\frac{(D^2-d^2)^3}{g\sqrt{(G_2-G_1)^2}}},$$

where $G_1$ is the loss of load on pumping unit 1 at the top of upstroke, $G_2$ is a weight of rod string 4, g is an acceleration of gravity, k is experimental coefficient of hydrodynamic resistance varied between 3 to 7, ρ is density of liquid in borehole 19 of the well, L is length of stroke, t is a time of upstroke, D is diameter of upper plunger 32, d is diameter of the damper plunger 11, S is the square area of at least one hole 15 in the damper chamber 8, π equals 3.1415.

In particular, for the 3.66 meter length of stroke of pumping unit 1, six stroke per minute or 5 seconds of upstroke time, weight of the rod string accounting for 1800 kg, loss of load on pumping unit at the top of upstroke accounting 3100 kg, diameter of plunger 32 accounting for 0.06985 m, diameter of plunger 11 equaled 0.05715 m, density of liquid equaled 1000 kg/m$^3$ and coefficient of hydrodynamic pressure drop equaled 4.0 the optimum square area of at least one hole 15 accounts for $1.32\times10^{-5}$ m$^2$.

The corresponding dampening counterforce F is determined by formulae:

$$F = \frac{\pi^3}{128}k\rho\frac{L^2}{t^2}\frac{(D^2-d^2)^3}{S^2}.$$

Figure 5:
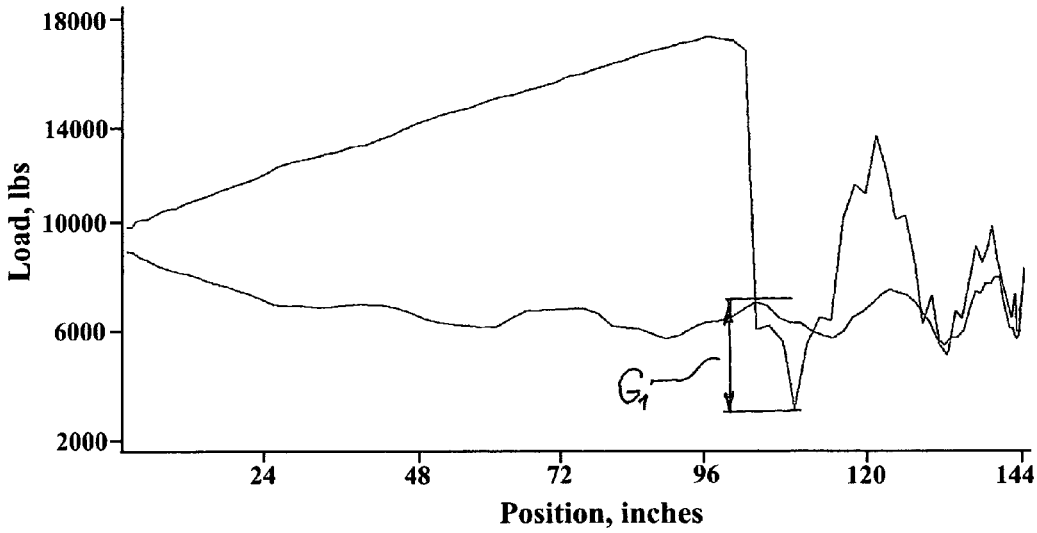
FIG. 5 is a dyno card of the load on pumping unit.

For above noted parameters the dampening counterforce F equals 12500 N or 2800 lb. The dyno card of the load on pumping unit using device in accordance with present invention is shown on FIG. 5. It's obvious from FIG. 5 that load on pumping unit does not reach zero after generating of shock wave which corresponds to the moment of very sharp drop of load on pumping unit on the dyno card.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

What is claimed is:

1. A method of providing a constant dampening counterforce for dampening the shocks in production wells having a tubing pump comprising the steps of:

a) positioning a device consisting of a elongated damper cylinder and damper chamber connected to each other, and the top of said elongated damper cylinder connected to the bottom of tubing string in borehole of the well filled by liquid, and the bottom of said chamber connected to the top of tubing pump, and the internal diameter of said elongated damper cylinder is less than internal diameter of tubing pump cylinder;

b) providing a damper plunger within said elongated damper cylinder and said damper plunger is connected to pumping unit by means of at least one sucker rod and polish rod at its upper end and said damper plunger is connected to tubing pump plunger its lower end by means of at least one sucker rod;

c) moving damper plunger through the elongated damper cylinder on upstroke to compress liquid inside said damper chamber;

d) creating a constant dampening counterforce inside damper chamber due to said compression of liquid in said damper chamber as a result of constant hydrodynamic resistance of liquid flowing through at least one channel made in damper plunger into the internal volume of said tubing string above said damper plunger thereby providing an additional constant pressure in damper chamber resulting in providing of said constant dampening counterforce inside damper chamber which is determined by a formulae:

$$F = \frac{\pi^3}{128} k\rho \frac{L^2}{t^2} \frac{(D^2 - d^2)^3}{S^2},$$

where F is a constant dampening counterforce, k is experimental coefficient of hydrodynamic resistance varied between 3 to 7, ρ is density of liquid in borehole of the well, L is length of stroke, t is the time of upstroke, D is diameter of tubing pump plunger, d is diameter of the damper plunger, S is the square area of at least one channel in the damper plunger, π equals 3.1415.

2. Apparatus for providing a dampening counterforce comprising a) a tubing string extending downwardly into the borehole of the well filled by liquid;

b) an elongated damper cylinder connected to the bottom of tubing string at the upper end and to a damper chamber at the lower end, and said damper chamber is connected to a tubing pump cylinder, and said elongated cylinder has an internal diameter smaller than internal diameter of said tubing pump cylinder;

c) a damper plunger movably arranged within said elongated damper cylinder and connected to the pumping unit by means at least one sucker rod and polish rod at the upper end and to the tubing pump plunger, movably arranged within said tubing pump cylinder, at the lower end for compressing the liquid contained within said damper chamber on upstroke of pumping unit and allowing said liquid inside damper chamber to flow through at least one channel made in damper plunger thereby providing a hydraulic connection between the damper chamber and the internal volume of tubing string above said damper plunger, and said at least one channel has a square area determined by the formulae:

$$S = \frac{\pi}{8} \frac{L}{t} \sqrt{\frac{\pi}{2} k\rho \frac{(D^2 - d^2)^3}{gG}},$$

where G is the required additional dampening load on pumping unit on the upstroke, k is experimental coefficient of the hydrodynamic resistance varied between 3 to 7, ρ is density of liquid in borehole of the well, L is length of stroke, t is a time of upstroke, D is diameter of tubing pump plunger, d is diameter of the damper plunger, S is the square area of at least one channel in the damper plunger, π equals 3.1415, g is a gravity acceleration, G=(0.1 to 10) $G_2$, wherein $G_2$ is weight of sucker rod string from surface to the damper plunger.

3. Apparatus as defined in claim 2, wherein said at least one channel connecting the damper chamber and the internal volume of tubing string above damper plunger is made as a groove on outer surface of the damper plunger or/and on internal surface of the elongated damper cylinder.

4. Apparatus as defined in claim 2, wherein a volume of said damper chamber is determined by the following expression:

$$\frac{\pi\beta f L(D^2 - d^2)}{4P_{max}} \le V \le \frac{\pi^2 \beta f L(D^2 - d^2)^2}{16G},$$

where V is the volume of the damper chamber, G is the required additional dampening load on pumping unit on the upstroke, L is length of stroke, D is diameter of tubing pump plunger, d is diameter of the damper plunger, π equals 3.1415, β is a compressibility of fluid in damper chamber, f is experimental coefficient of fluid leakage between, correspondingly, elongated damper cylinder and damper plunger and tubing pump cylinder and tubing pump plunger (f=0.5 to 0.7), $P_{max}$ is a collapse resistance pressure of damper chamber ($P_{max}$=56 to 74 MPa).

5. Apparatus as defined in claim 2, wherein there are a plurality of channels connecting the damper chamber and the internal volume of tubing string above damper plunger and each channel has a square area defined by the formulae:

$$S_i = k_i \frac{S}{n},$$

where $S_i$ is square area of one of channels connecting the damper chamber and the internal volume of tubing string above damper chamber, $k_1$ is coefficient of hydrodynamic resistance in each of channels ($k_1$=3 to 7), n is number of channels, S is total square area of plurality of channels and i=1, 2, 3 . . . n.

6. Apparatus as defined in claim 2, wherein the device for generating a shock waves connected to the bottom of damper chamber is used instead of tubing pump and said apparatus for generating shock waves comprising an upper cylinder having smaller internal diameter than lower cylinder connected to each other via compression chamber, a plunger assembly including upper and lower plungers movably arranged within said upper and lower cylinders, correspondingly, and said upper and lower plungers are connected to each other by means of at least one rod and said upper plunger is connected to the bottom of damper plunger by at least one rod for compressing a liquid contained within said compression chamber and discharging the liquid into borehole when said lower plunger exits out of said lower cylinder on upstroke thereby generating a shock wave.

7. Apparatus as defined in claim 6, wherein said damper plunger does not have said at least one channel but said damper chamber has at least one hole providing hydraulic communication between damper chamber and borehole of the well and said hole has a square area determined by the formulae:

$$S = \frac{\pi}{8}\frac{L}{t}\sqrt{\frac{\pi}{2}k\rho\frac{(D^2-d^2)^3}{g(G_2-G_1)}},$$

where $G_1$ is the loss of load on pumping unit at the top of upstroke, $G_2$ is a weight of sucker rod string from surface to the damper plunger, g is an acceleration of gravity, k is experimental coefficient of hydrodynamic resistance varied between 3 to 7, ρ is density of liquid in borehole of the well, L is length of stroke, t is a time of upstroke, D is a diameter of said upper plunger of apparatus for generating shock waves, d is diameter of the damper plunger, S is the square area of at least one hole in the damper chamber, π equals 3.1415, g is gravity acceleration, $G_1$=(1 to 1.5)$G_2$.

8. Apparatus as defined in claim 7, wherein the damper plunger has the diameter bigger than the diameter of the upper plunger of apparatus for generating shock waves for vacuuming the liquid contained within the damper chamber and allowing the liquid from borehole of the well to be discharged into the damper chamber on upstroke of pumping unit thereby providing a dampening counterforce inside said damper chamber in accordance with a formulae:

$$F = \frac{\pi^3}{128}k\rho\frac{L^2}{t^2}\frac{(d^2-D^2)^3}{S^2},$$

where F is counterforce, k is experimental coefficient of hydrodynamic resistance varied between 3 to 7, ρ is density of liquid in borehole of the well, L is length of stroke, t is the time of upstroke, D is diameter of said upper plunger of apparatus for generating shock waves, d is diameter of the damper plunger, S is the square area of at least one hole in the damper chamber, π equals 3.1415.

9. Apparatus as defined in claim 7, wherein at least one hole in damper chamber has an angle ϕ of axis of symmetry different from 90° relatively the longitudinal axis of symmetry of the damper chamber.

* * * * *